US006003173A

United States Patent [19]

Meoli, Jr. et al.

[11] Patent Number: 6,003,173

[45] Date of Patent: Dec. 21, 1999

[54] HAMMOCK

[75] Inventors: Rudy B. Meoli, Jr., Placentia; Armando Padilla, Torrance, both of Calif.

[73] Assignee: E-Z Sales & Manufacturing, Gardena, Calif.

[21] Appl. No.: 08/609,550

[22] Filed: Mar. 1, 1996

[51] Int. Cl.[6] ..... A45F 3/22

[52] U.S. Cl. ..... 5/120; 5/123

[58] Field of Search ..... 5/120, 122, 123, 5/127, 98.3

[56] References Cited

U.S. PATENT DOCUMENTS

| | | | |
|---|---|---|---|
| 221,754 | 11/1879 | Travers | 5/122 |
| 342,668 | 5/1886 | Woodbury | 5/122 |
| 369,546 | 9/1887 | Nickerson | 5/123 |
| 416,242 | 12/1889 | Sutphen | 5/123 |
| 468,576 | 2/1892 | Palmer | 5/123 |
| 469,869 | 3/1892 | Palmer | 5/123 |
| 631,747 | 8/1849 | Lloyd | 5/123 |
| 1,515,263 | 11/1924 | Matsusaki | 5/122 |

FOREIGN PATENT DOCUMENTS

| | | | |
|---|---|---|---|
| 49143 | 7/1911 | Austria | 5/123 |

*Primary Examiner*—Terry Lee Melius
*Assistant Examiner*—Fredrick Conley
*Attorney, Agent, or Firm*—Chris Papageorge

[57] ABSTRACT

An improved hammock includes a body supporting member for a user to lie on, suspension cords, retainer rings and ropes for attachment to an external support structure. The cords interconnect the rings and body supporting member at longitudinal end portions thereof so that the body supporting member may be suspended from the external support structure. A pair of spreader bars positioned adjacent the longitudinal end portions of the body supporting member are provided with spaced apertures which receive the suspension cords therein and laterally space apart the cords in order to laterally extend the body supporting member to provide full and adequate lateral support to the user. The spreader bars are laterally curved outwardly and are split proximal to or at the apertures into upper and lower members to provide open access to the apertures so that the cords may be inserted into the apertures when the upper and lower members are separated. Snap connectors on the spreader bar enable the upper and lower members to be securely joined together thereby blocking access to the apertures and preventing removal of the cords from the apertures when the members are joined together.

22 Claims, 7 Drawing Sheets

FIG. 3
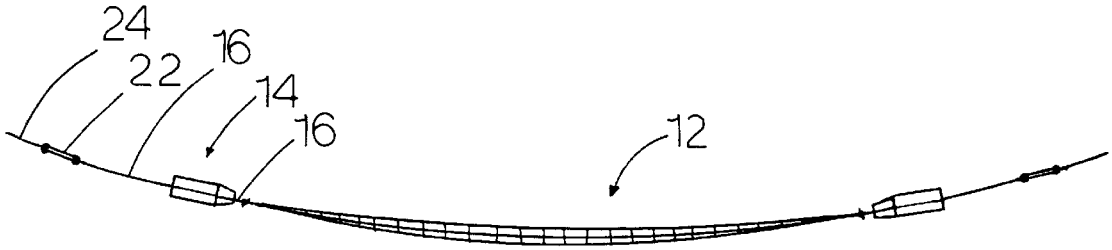
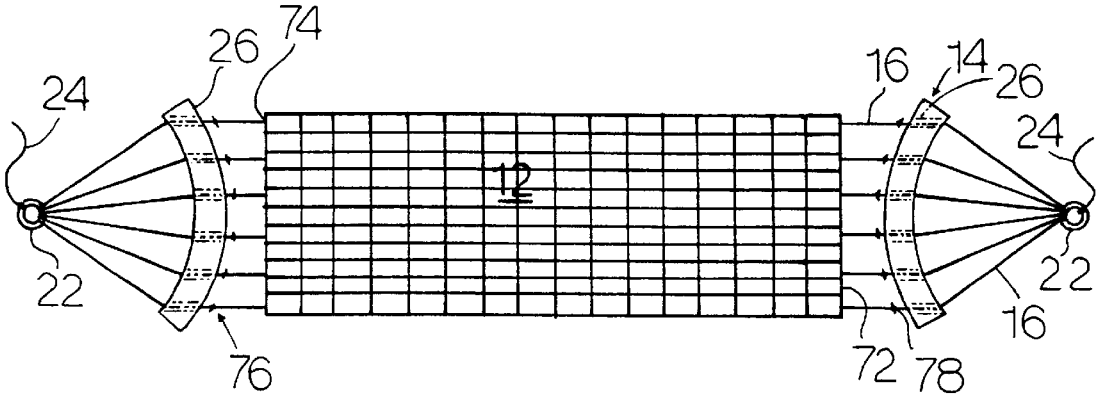
FIG. 2

FIG. 8
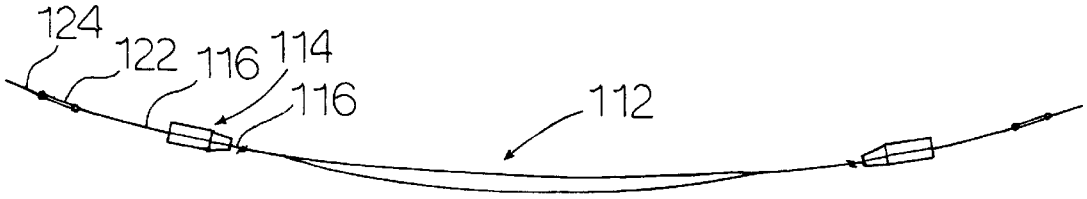
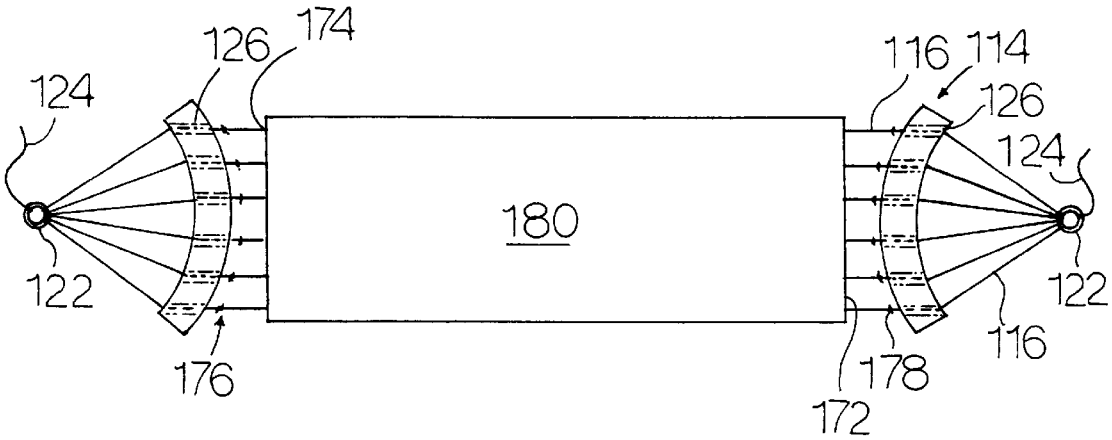
FIG. 7

HAMMOCK

BACKGROUND OF THE INVENTION

The invention generally relates to hammocks and more particularly to a hammock which has an improved spreader bar making the hammock safer to use and which facilitates assembly thereof by an assembly plant.

Hammocks are an inexpensive apparatus for supporting an individual in a reclining position. They are especially useful because they are adaptable for use in many different types of outdoor environments due to their advantageous feature of requiring simply the availability of two suitably separated structures to which attachment ropes may be secured and thus may be suspended from trees, poles and many other types of structures. Hammocks may thus be used in locales where tents and other types of rest providing equipment may not pragmatically be used due to rocky terrain, excessive vegetation, wet ground surfaces, etc. Consequently, hammocks have been widely used in conjunction with camping and other types of outdoor recreational activities. For such outdoor use hammocks also have the added advantage that since they are typically suspended above the ground which may often be hard, rocky, uneven, wet, cold, dirty or infested with insects they can provide comfort to the user in spite of such undesirable ground surface characteristics.

Some of the oldest designs for hammocks utilize spreader bars to separate the suspension cords and thereby laterally extend the body supporting member of the hammock to provide fuller and generally flatter support and thereby a more comfortable surface for the user to lie on. However, such spreader bars have typically been laterally straight which has the disadvantage that the stresses placed thereon by the suspension cords are unevenly distributed on the bars, and this may result in breakage of the bar or produce an unstable hammock which is more likely to rotate while in use and dump the user. Conventional spreader bars for hammocks typically are provided with apertures for the suspension cords to pass through and also are of unitary construction which requires the hammock to be assembled by feeding the cords through the apertures and subsequently securing the cords to the other components of the hammock. This requirement makes the assembly of such hammocks more labor intensive which increases the cost of the hammock.

Many types of hammocks utilize a spreader bar at the longitudinal ends of the body supporting member to maintain the supporting member in a laterally spread position. An example of such a hammock design is disclosed in U.S. Pat. No. #4,800,601 to DeCaro. DeCaro utilizes a straight bar which has angled retaining members forming one C-shaped slot at one end thereof which holds the ends of the supporting member in a spread condition and another C-shaped slot at the other end thereof which holds the ends of the supporting cords therein. Although the DeCaro hammock was designed to be more inexpensive to manufacture than hammocks with comparable features, it nevertheless requires considerable labor to attach the suspension cords to the spreader bar. This additional labor requirement adds significantly to its costs of manufacture.

Many other types of hammocks utilize relatively simple spreader bar designs to provide the desired function of laterally spreading out the body supporting member. Examples of such hammocks are disclosed in U.S. Pat. Nos. #4,162,550 to Willingham and #4,686,720 to Newell. The Willingham hammock utilizes a spreader bar which is straight and provided with apertures through which the suspension cords pass. The Willingham spreader bar is directly secured to the body supporting member at the ends thereof while the Newell spreader bar is secured to suspension cords which are secured to the body supporting member at the ends thereof. However, such designs have the disadvantage that the forces exerted on the spreader bar are concentrated at the end portions thereof. This may produce undue stresses at these portions potentially resulting in failure of the components or flipping over of the hammock under use because the forces are not evenly distributed laterally.

Other types of hammocks include spreader bars which are designed to provide a taut hammock sheet for firmer support and enhanced user comfort. An example of such a hammock is disclosed in U.S. Pat. No. #4,021,868 to Fueslein. The Fueslein design includes spreader members which are positioned underneath the hammock sheet at medial portions and proximal end portions thereof. The spreader members are vertically curved in order to space them from the sheet and prevent contact thereof with the user. However, since the suspension cord connection points are located at only the peripheral lateral edges of the sheet, the forces of suspension are concentrated at these edges instead of being evenly distributed throughout more of the entire sheet. Thus, such designs have the disadvantage that they may not be able to withstand prolonged use without tearing, loosening of the connections, etc.

A hammock is thus needed which is safer to use and more inexpensive to manufacture. A hammock is also needed which provides these features while being simple in construction and thus easy to use.

SUMMARY OF THE INVENTION

It is a principal object of the present invention to provide a hammock which provides enhanced safety to the user.

It is another object of the present invention to provide a hammock which provides more even distribution of forces exerted on components thereof.

It is also an object of the present invention to provide a hammock which provides reduced stress on components thereof.

It is also an object of the present invention to provide a hammock which requires minimal labor for assembly thereof.

It is also an object of the present invention to provide a hammock which is simple in construction and easy to use.

Basically, the improved hammock of the present invention is specifically designed to minimize the stresses on the components thereof by providing more even distribution of the forces exerted on components of the hammock by the user's weight. By minimizing stresses and providing more even distribution of forces, the improved hammock reduces the likelihood that the user's weight will produce unbalanced forces resulting in rotation of the hammock and thereby toppling of the user and reduces the likelihood that concentration of forces will result in breakage, failure or malfunction of overstressed components of the hammock. The improved hammock achieves this goal through its incorporation of two uniquely shaped spreader bars. The spreader bars are mounted on the suspension cords which are attached to a body supporting member which the user lies on. One of the spreader bars is positioned at one longitudinal end of the body supporting member while the other of the spreader bars is positioned at the other longitudinal end of a body supporting member. The spreader bar is curved horizontally and is also horizontally split into an upper and a lower member. The spreader bars also include apertures which extend through the spreader bars. Suspension cords extend through the apertures and are connected to the body supporting member. The curvature of the spreader bar places the stresses resulting from the user's weight at the inner wall portions of the apertures, and this location is that where the cords come into contact with the aperture walls. Additionally, the curvature of the spreader bar distributes the stresses evenly on these wall portions of every aperture so that all the apertures bear the forces transferred to the spreader bar. In contrast, conventional straight bar designs concentrate the stresses on the walls of predominantly the outer apertures and also concentrate these stresses on the lower wall portions of these apertures. Conventional designs direct the forces perpendicular to the direction of elongation of the spreader bar such that the forces act in a direction in which the bar is structurally weakest making it more likely to bend the bar thereby producing cracking or breakage thereof. In contrast, the improved design of the present invention directs the forces parallel to the direction of elongation such that forces act in a direction in which the bar is structurally strongest making the spreader bar better able to withstand these forces. In addition, these forces are distributed over all of the cords in the hammock of the present invention. In contrast, conventional straight bar designs concentrate the stresses on only the outer cords, and this resulting concentration of stresses on the corresponding aperture wall portions may result in wearing away of this wall portion of these apertures. Consequently, the more even distribution of stresses provided by the improved hammock design reduces the likelihood of premature wear, breakage or failure of components of the hammock. In addition, due to the more even distribution of forces, shifting of the user's weight results in smoother transfer of forces to adjacent cords (and spreader bar portions), whereas in conventional straight bar designs the user's weight is borne by predominantly only the outer cords so that transfer of weight is likely to occur only between these two cords (which are not adjacent each other) and between opposite end portions of the spreader bar. Thus, the improved design of the hammock of the present invention makes it less likely that the hammock will suddenly rotate completely around or rotate to an excessive degree resulting in toppling of the user from the hammock. In contrast, in conventional hammocks using a straight bar, shifting of the user's weight laterally may result in transfer of the user's weight completely off one of the lateral end portions of the spreader bar producing a severe unbalancing of the load and resulting in sudden rotation of the hammock and toppling of the user.

The improved hammock of the present invention is also specifically designed to facilitate assembly of the hammock reducing the labor costs involved and thereby reducing the cost of manufacture. The unique bifurcated design of the spreader bar of the improved hammock facilitates installation of the spreader bar onto the suspension cords of the hammock and allows such installation to be performed after the suspension cords are attached to other components of the hammock. In conventional hammock assembly processes, the suspension cords must be threaded through the apertures of the spreader bar before being attached to other components of the hammock. In such conventional assembly processes the spreader bar is installed onto the cords while the cords are being attached to, for example, the retainer rings, and this positions the spreader bars in the way of the cord attachment process thereby making the process more awkward and more labor intensive. In contrast, the improved hammock incorporates a spreader bar which is horizontally split into an upper and a lower member, and the separation of the members exposes an open wall of each of the apertures thereby providing access directly to each of the apertures. The members are separate from each other prior to assembly of the hammock allowing the suspension cords to be inserted into the apertures of the spreader bar while the cords are attached to the other components of the hammock. The installation of the cords into the apertures is thus less labor intensive than prior art hammock designs. After installation of the cords into the apertures, the upper and lower members are simply joined together whereas in prior art hammocks the cords must be attached to other components which is more awkward and difficult because the bars have become a part of the assembly and likely to be in the way of the attachment process. Assembly of the hammock of the present invention is thus less labor intensive than conventional hammocks resulting in a more inexpensive hammock.

The suspension cords are connected to a pair of retainer rings which serve to bring together and retain the outer ends of the cords in a generally converged position. A pair of ropes are also connected to the rings, and tying or otherwise attaching the ropes to a suitable pair of trees, poles, etc. provides the desired suspension of the hammock therefrom. When the spreader bars are mounted around the suspension cords, the spreader bars perform their desired function of spreading the suspension cords apart. This in effect laterally extends the body supporting member and thereby provides a wider and more effective support for the user's body when the suspension cords are properly taut.

BRIEF DESCRIPTION OF THE DRAWINGS

FIG. 2 is a top view of the first embodiment showing the positioning of the components thereof.

FIG. 3 is a side elevational view of the first embodiment.

FIG. 7 is a top view of a second embodiment of the hammock of the present invention showing the positioning of the components thereof.

FIG. 8 is a side elevational view of the second embodiment.

DETAILED DESCRIPTION OF THE PREFERRED EMBODIMENTS

Figure 1:
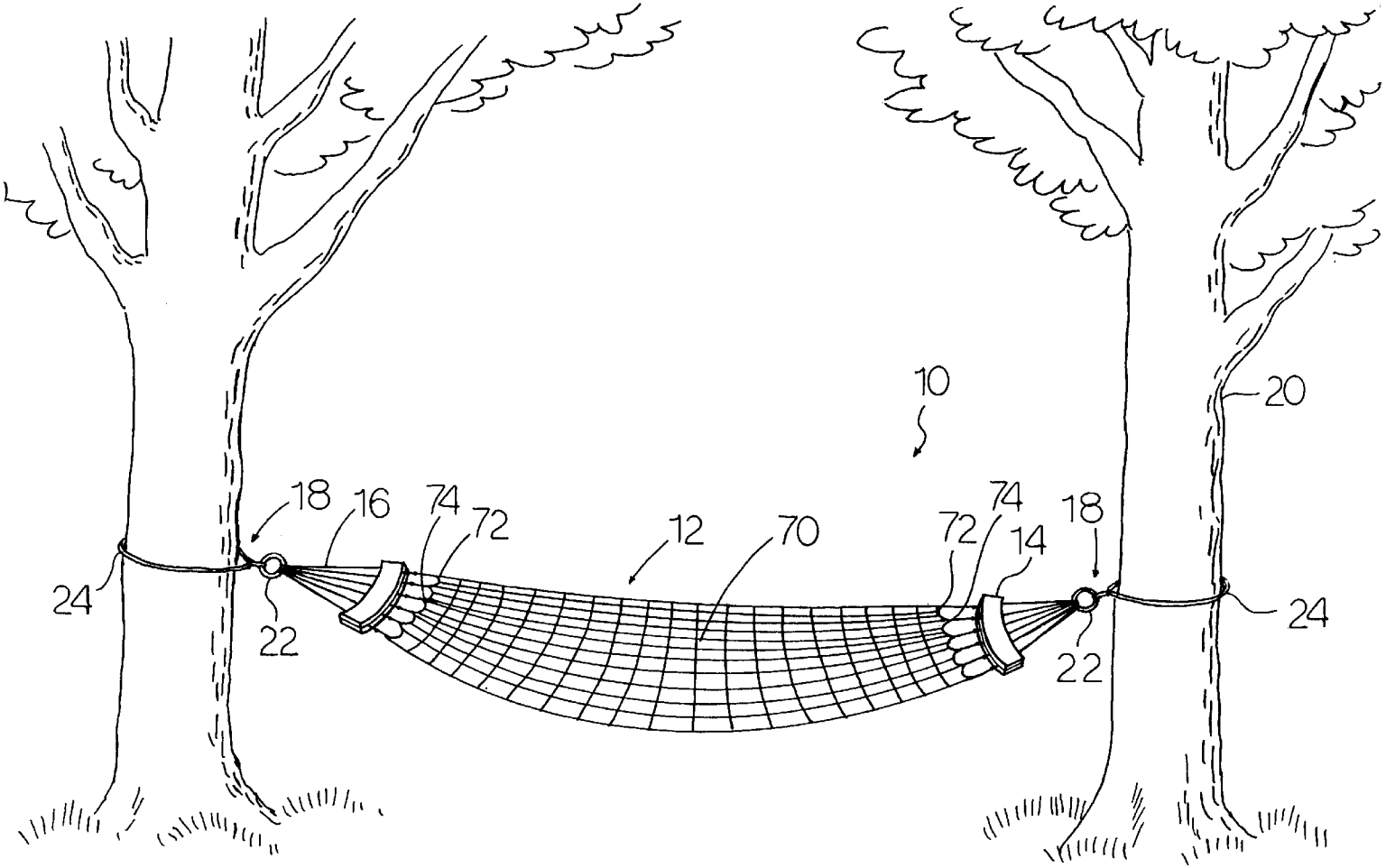
FIG. 1 is a perspective view of a first embodiment of the hammock of the present invention depicted as fully assembles and shown suspended from a pair of trees.
Figure 4:
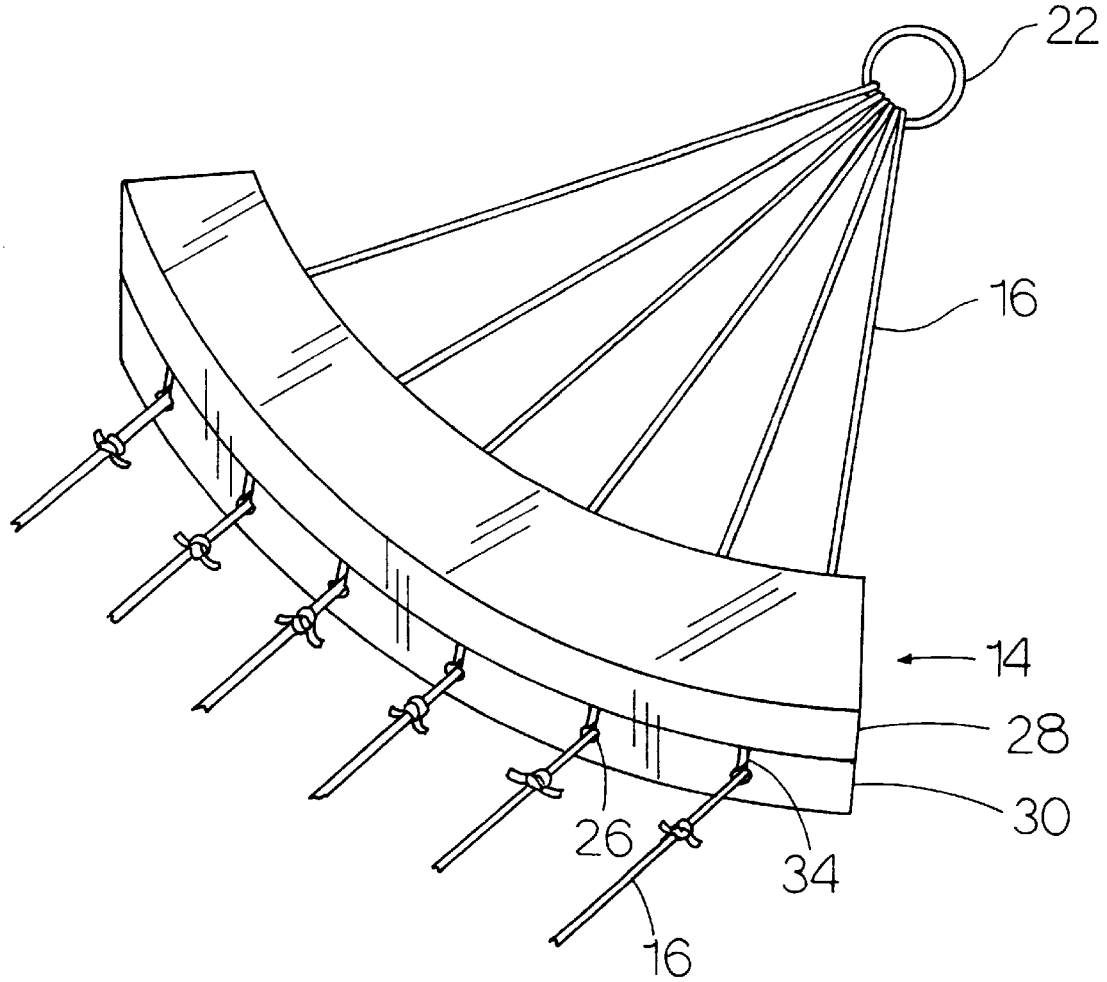
FIG. 4 is a perspective view of representative components of the first embodiment showing component suspension cords inserted in the apertures of a component spreader bar.

A first embodiment of the hammock of the present invention, generally designated by the numeral 10, has several major parts including a body supporting member 12, a pair of spreader bars 14 and a set of suspension cords 16. As shown in FIG. 1, hammock 10 also has a means for attaching 18 the major component parts to a pair of trees 20 or other suitable external structure. The means for attaching 18 preferably includes a pair of retainer rings 22 to which the set of cords 16 are attached and a pair of ropes 24 connected to the rings at a diametrically opposed portion thereof. The ropes 24 are tied to the trees 20 and thereby resulting in suspension of the body supporting member 12 and the other component parts of the hammock 10 from the trees 20.

Figure 6:
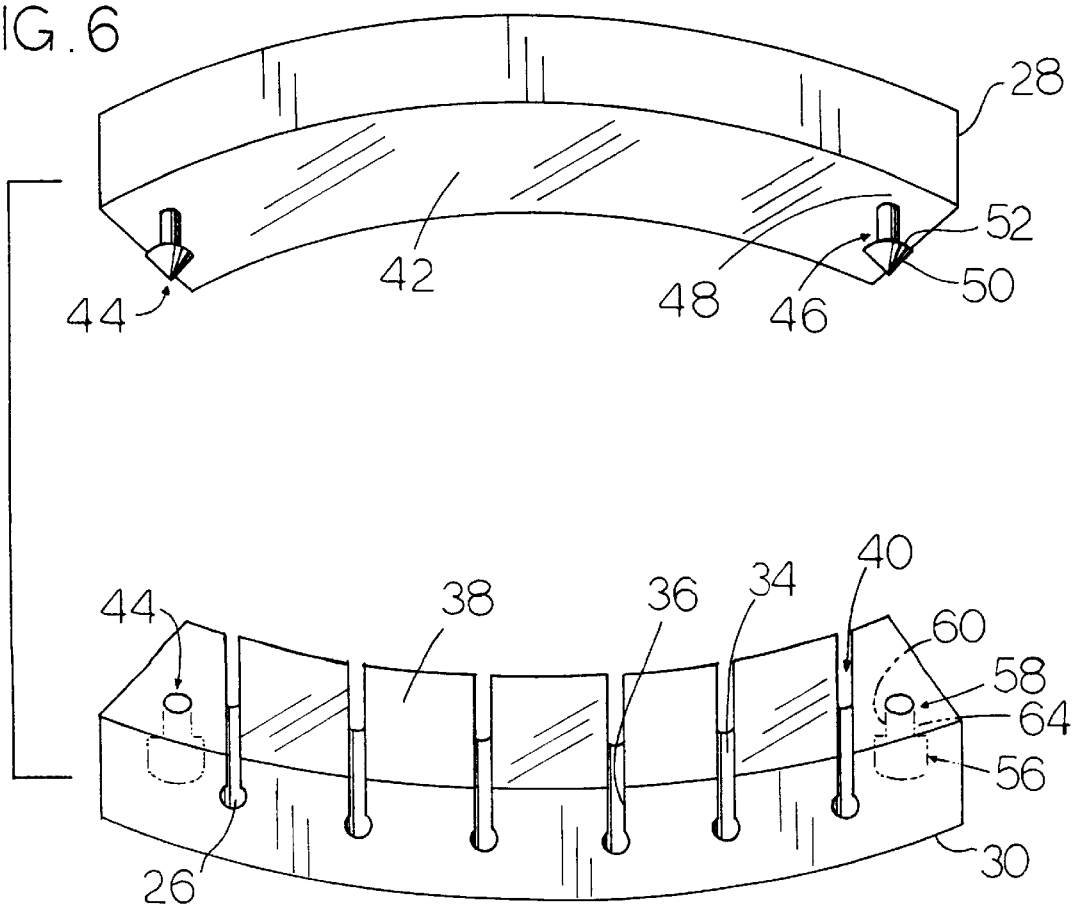
FIG. 6 is a front perspective exploded view of the representative component spreader bar of the first embodiment.

The pair of spreader bars 14 are preferably provided with apertures 26 which extend completely through the spreader bars 14 in a generally horizontal direction. The apertures 26 receive the set of suspension cords 16 therein and serve to laterally spread apart the suspension cords 16, as shown in FIG. 2. The apertures 26 are preferably also laterally aligned and this serves to bring the suspension cords 16 into lateral (or horizontal) alignment at a location proximal to the body supporting member 12. When the ropes are tightly connected to the trees 20 and the body supporting member 12 bears the weight of the user such that the suspension cords 16 are taut, the spreader bars 14 also serve to laterally spread apart the body supporting member 12 in order to provide fuller support to the user. The apertures 26 are preferably also evenly spaced apart in order to evenly distribute the suspension forces exerted on the spreader bars 14 and the suspension cords 16. The apertures 26 are preferably also longitudinally oriented, mutually parallel and longitudinally straight, as shown in FIGS. 2 and 6. The apertures 26 are preferably six in number, and the bar 14 preferably does not include an aperture at the center thereof. The apertures 26 are preferably larger in cross-sectional size than the individual cords 16 in order to allow free movement of the cords 16 relative to and within the apertures 26.

The spreader bars 14 are preferably curved horizontally and longitudinally outwardly relative to the body supporting member 12, as shown in FIG. 2, so that the suspension forces are evenly distributed horizontally on the bars 14. Each of the apertures 26 thus bears approximately the same degree of force of suspension as the other apertures 26 resulting in reduced concentration of stress on the bars 14 as well as on the apertures 26. The arc of curvature of the bars 14 preferably has a radius of approximately twenty-two inches. Due to the unique curved shape of the spreader bars 14, the suspension forces exerted on the apertures are located at the inner portions 21 of the walls 32 which define the apertures 26.

Figure 5:
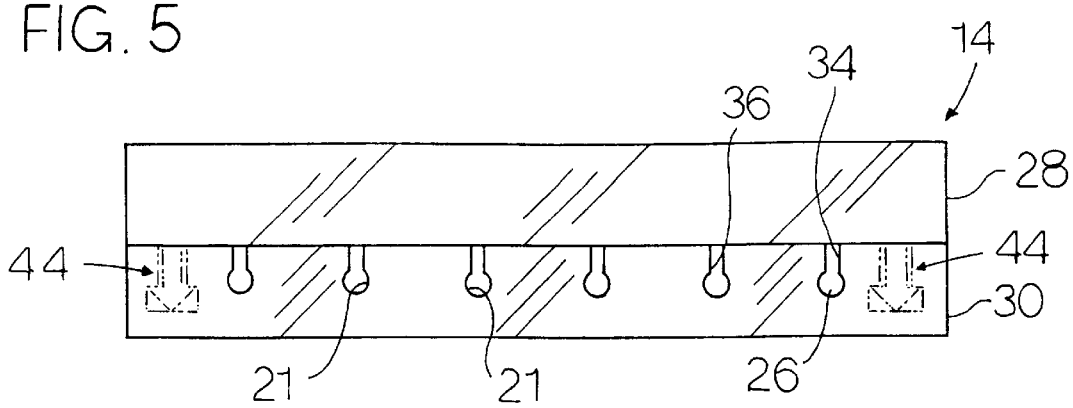
FIG. 5 is a front plan view of the representative component spreader bar of the first embodiment showing the feature thereof in more detail.

Each of the pair of spreader bars 14 is preferably divided or split horizontally into an upper bar member 28 and a lower bar member 30, as shown in FIGS. 5 and 6. The lower bar member 30 is preferably provided with the apertures 26 which preferably also extend horizontally through the lower bar member 30 in preferably a longitudinal direction. The apertures 26 are preferably tubular and have walls 32 which define them. Lower bar member 30 is preferably also provided with channels 34 positioned at the upper portions 36 of the walls 32. The channels extend from the upper portions 36 of the walls 32 to the upper surface 38 of the lower bar member 30 thereby providing an opening 40 extending from the apertures 26 to the upper surface 38 of the lower bar member 30. The channels 34 thus provide access to the apertures 26 enabling the set of cords 16 to be inserted through the channels 34 and into the apertures 26 resulting in simple, fast and easy installation of the cords 16 into the apertures 26. The channels 34 are preferably oriented so that they are perpendicular to the surface 38. Advantageously, the installation of the cords 16 may be performed when the remaining components of the hammock 10 are assembled together or prior thereto.

Upper bar member 28 preferably has a generally flat lower surface 42 so that when the upper and lower bar members 28 and 30 are positioned together such that the upper surface 38 is adjacent the lower surface 42 the lower surface 42 covers the openings 40, as shown in FIG. 5. This effectively blocks access to the channels 34 and the apertures 26 via the top of the lower bar member 30. Thus, when the upper and lower bar members 28 and 30 are positioned together, the cords 16 cannot be removed from the apertures 26 without their disconnection from the rings 22 and/or body supporting member 12.

Each of the upper and lower bar members 28 and 30 preferably have snap connectors 44 enabling the members 28 and 30 to be securely joined together by simply pressing the upper and lower bar members 28 and 30 together, as shown in FIGS. 5 and 6. The snap connectors 44 preferably include male connectors 46 mounted on the upper bar member 28 and at the lower surface 42 and at end portions 48 thereof. Each male connector 46 preferably includes an inverted cone structure 50 with a horizontally flat surface 52 at its medial portion 54. The snap connectors 44 also preferably include female connectors 56 mounted on the lower bar member 30 at the upper surface 38 and at end portions 58 thereof. Each female connector 56 preferably includes a constriction 60 at the upper portion 62 thereof which has a horizontally flat surface 64 at its medial portion 66. The taper of the cone structure of the male connector 46 facilitates insertion of the male connector 46 into the female connector 56 until the upper and lower surfaces 38 and 42 are adjacent to and contacting each other. In this relative position the horizontal surface 64 of the female connector 56 is above but adjacent to the horizontal surface 52 of the male connector 46 thereby effectively retaining the connectors 46 and 56 and the upper and lower bar members 28 and 30 in a joined together position. Once the upper and lower bar members 28 and 30 are joined together, the cords 16 cannot be removed from the apertures 26 via the channels 34 and are thus effectively retained therein.

The body supporting member 12 preferably includes a set of support cords 68 which are interconnected to form a net 70. The set of suspension cords 16 are preferably connected to opposing longitudinal ends 72 of the net 70 at connection points 74 thereof which are evenly spaced apart in order to evenly distribute the suspension forces exerted on the net 70. The suspension cords 16 are also preferably knotted at locations 76 thereof between the net 70 and the spreader bars 14. Alternatively, the knots 78 may result from tying together the suspension cords 16 and support cords 68 at the ends 72 in order to interconnect the cords 16 and the body supporting member 12. The knots 78 are preferably larger than the diameter of the apertures 26 to prevent the spreader bars 14 from sliding down over the knots 78 and excessively close to or encroaching on the net 70. This prevents the spreader bars 14 from undesirably contacting the user's head or feet and thereby interfering with the user's comfort.

A second embodiment 110 of the invention is depicted in FIGS. 7 through 11. The second embodiment 110 is essentially identical to the first embodiment 10 except for the orientation of the apertures 126, the structure of the male connectors 146 and the omission of the channels 34.

Figure 9:
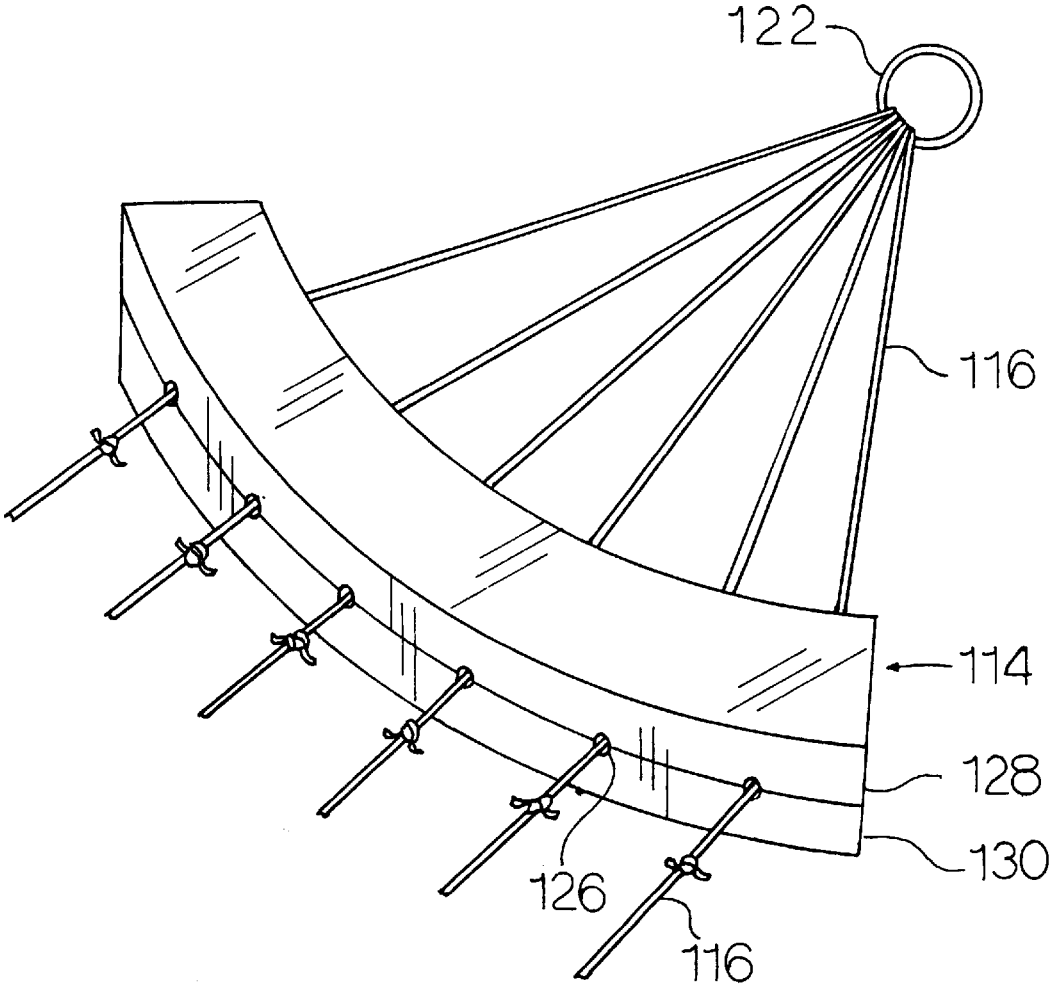
FIG. 9 is a perspective view of representative components of the second embodiment showing component suspension cords inserted in the apertures of a component spreader bar.

As with embodiment 10, embodiment 110 also includes a pair of spreader bars 114 which are also preferably curved horizontally and longitudinally outwardly relative to the body supporting member 112 so that the suspension forces are evenly distributed horizontally on the bars 114 in order to minimize the concentration of stresses on the bars and other components of the hammock 110, as shown in FIGS. 7 and 9. The arc of curvature of the bars 114 preferably has a radius of approximately twenty-two inches. The center point of the arc of curvature of the bars 114 is approximately at the respective ring 122 to which the set of cords 116 passing through the bars are connected. The spreader bars 114 are also preferably laterally dimensioned so that they are approximately equal to the shoulder width of an average size user.

The pair of spreader bars 114 are preferably also provided with apertures 126 which extend completely through the spreader bars 114, as shown in FIG. 7. The apertures 126 receive the set of suspension cords 116 therein and serve to laterally spread apart the suspension cords 116. The apertures 126 ore preferably also evenly spaced apart in order to evenly distribute the suspension forces exerted on the spreader bars 114 and the suspension cords 116. The apertures 126 are preferably six in number although more or less than this number may be utilized, if desired. The apertures 126 are preferably also radially oriented with reference to the arc of curvature of the particular bar 114 having the particular apertures 126 (and with reference to the means for attaching 118 and, more exactly, to the ring 122 corresponding to the particular spreader bar 114 of the apertures 126 i.e., the center of the arc of curvature of the bars 114) and preferably straight. Due to the unique curved shape of the spreader bars 114, the suspension forces exerted on the apertures 126 are located at the inner portions 121 of the walls 132 which define the apertures 126, as shown in FIG. 10.

Figure 10:
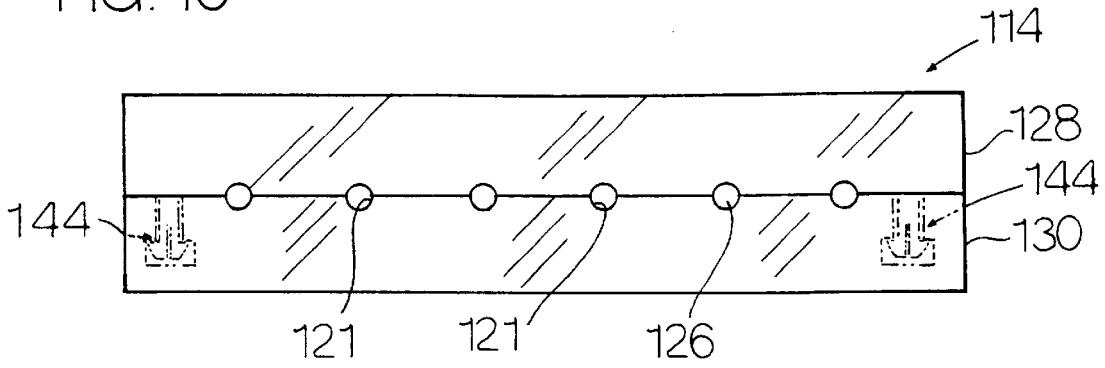
FIG. 10 is a front plan view of the representative component spreader bar of the second embodiment showing the features thereof in more detail.
Figure 11:
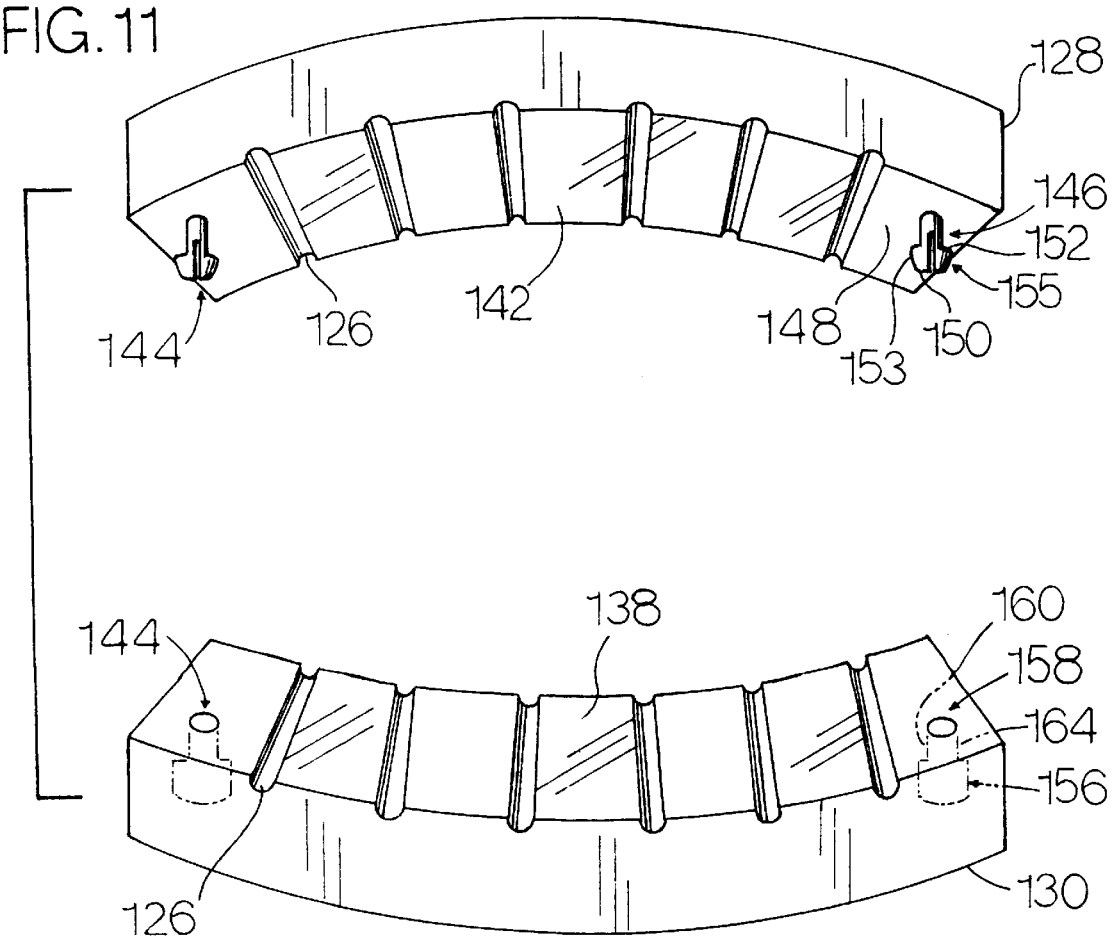
FIG. 11 is a front perspective exploded view of the representative component spreader bar of the second embodiment.

Each of the pair of spreader bars 114 is preferably divided or split horizontally into an upper bar member 128 and a lower bar member 130, as shown in FIGS. 10 and 11. Preferably both the upper bar member 128 and lower bar member 130 include a respective portion of the walls 132 which define the apertures 126. Thus, the plane of division which bisects the bar members 128 and 130 preferably also bisects the apertures 126 and more preferably bisects the apertures 126 into halves. The upper and lower bar members 128 and 130 have preferably flat lower surfaces 142 and flat upper surfaces 138 respectively which lie in or adjacent to the plane of division when the upper and lower bar members 128 and 130 are positioned together and the surfaces are positioned adjacent each other. Separation of the upper and lower bar members 128 and 130 thus provides access to the apertures 126 enabling the set of cords 116 to be inserted directly into the apertures 126 resulting in simple, fast and easy installation of the cords 116 into the apertures 126. Advantageously, the installation of the cords 116 may be performed when the remaining components of the hammock 110 are assembled together or prior thereto.

As with embodiment 10, each of the upper and lower bar members 128 and 130 preferably have snap connectors 144 which preferably include male connectors 146 mounted on the upper bar member 128 and at the lower surface 142 and at end portions 148 thereof, as shown in FIGS. 10 and 11. Each male connector 148 is preferably forked and includes prongs 150 with protuberances 153 having a horizontally flat surfaces 152 at lower portions 155 of the connector 146. The snap connectors 144 also preferably include female connectors 156 mounted on the lower bar member 130 at the upper surface 138 and at end portions 158 thereof. Each female connector 156 preferably includes a constriction 160 at the upper portion 162 thereof which has a horizontally flat surface 164 at its medial portion 166. The coengaging male and female connectors 146 and 156 enable the upper and lower bar members 128 and 130 to be securely joined together. Alternatively, the upper and lower bar members 128 and 130 may simply be screwed together.

The body supporting member 112 preferably includes a sheet 180 composed of suitable fabric to support the body of the user thereon. The sheet 180 is preferably rectangular but may also be any other suitable shape. The set of suspension cords 116 are preferably connected to opposing longitudinal ends 172 of the sheet 180 at connection points 174 thereof which are evenly spaced apart in order to evenly distribute the suspension forces exerted on the sheet 180, as shown in FIGS. 7 and 10. The suspension cords 116 are also preferably knotted at locations 176 thereof inward of the spreader bars 114 and between the net 170 and the spreader bars 114. The knots 178 are preferably larger than the diameter of the apertures 126 to prevent the spreader bars 114 from sliding down over the knots 178 and excessively close to or encroaching on the sheet 180. As with embodiment 10, this prevents the spreader bars 114 from undesirably contacting the user's head or feet and thereby interfering with the user's comfort.

Accordingly, there has been provided, in accordance with the invention, an improved hammock which provides enhanced user safety and facilitates assembly thereof. It is to be understood that all the terms used herein are descriptive rather than limiting. Although the invention has been described in conjunction with the specific embodiments set forth above, many alternative embodiments, modifications and variations will be apparent to those skilled the art in light of the disclosure set forth herein. Accordingly, it is intended to include such alternative embodiments, modifications and variations that fall within the spirit and scope of the invention as set forth in the claims hereinbelow.

What is claimed is:

1. A hammock, comprising:

a body supporting member;

a set of suspension cords connected to said body supporting member;

means for attaching said set of suspension cords to a support structure for suspension of said body supporting member therefrom;

a pair of spreader bars, one of said pair of spreader bars positioned at one longitudinal end of said body supporting member and the other of said bars positioned at the longitudinal end of said supporting members, said pair of bars split into upper and lower bar members, said pair of bars having apertures extending through said pair of bars and receiving said of suspension cords therein, said pair of spreader bars curved horizontally and longitudinally relative to said body supporting member.

2. The hammock of claim 1 wherein said pair of spreader bars further includes channels extending along entire length of the apertures, said channels located and oriented so that the apertures are open along their entire length at a side portion of walls defining the apertures thereby providing access thereto when said upper and lower bar members are separated from each other and closed at the one side thereof when said upper and lower bar members are joined together.

3. The hammock of claim 1 wherein plane of division bisecting each of said pair of spreader bars into said upper and lower bar members intersects the apertures through their entire length so that said upper bar members include at least a portion of walls defining the apertures and said lower bar members include other portions of said walls thereby providing access to the apertures when said upper and lower bar members are separated from each other and closure of the walls when said upper and lower bar members are joined together.

4. The hammock of claim 1 wherein the apertures are longitudinally oriented and parallel to each other.

5. The hammock of claim 1 wherein the apertures of each of said pair of spreader bars are oriented radially outwardly from and with reference to said means for attaching.

6. The hammock of claim 1 wherein the apertures are evenly spaced apart.

7. The hammock of claim 1 wherein cross-sectional size of the apertures is larger than cross-sectional size of individual cords of said set of suspension cords to allow free movement of said set of suspension cords relative to and within the apertures.

8. The hammock of claim 1 wherein width of said pair of spreader bars is approximately equal to shoulder width of an average size user.

9. The hammock of claim 1 wherein said pair of spreader bars includes coengageable male and female connectors for securing said upper and lower bar members together.

10. The hammock of claim 1 wherein said body supporting member includes a set of support cords interconnected to form a net.

11. A hammock, comprising:

a body supporting member;

a set of suspension cords connected to said body supporting member;

means for attaching said set of suspension cords to a support structure for suspension of said body supporting member therefrom;

a pair of spreader bars, one of said pair of spreader bars positioned at one longitudinal end of said body supporting member and other of said pair of bars positioned at other longitudinal end of said supporting member, said pair of bars horizontally curved longitudinally outwardly relative to said body supporting member, said pair of bars having apertures for receiving said set of suspension cords therein.

12. The hammock of claim 11 wherein said pair of spreader bars has a radius of curvature of approximately twenty-two inches.

13. The hammock of claim 11 wherein each of said pair of spreader bars includes an upper and a lower bar member, said upper and lower bar members having snap connectors for secure interconnection thereof, said lower member having channels extending along entire length of the apertures providing access to the apertures when said upper and lower members are separated for allowing insertion of said set of suspension cords therein when said set of cords are interconnecting said means for attaching and said body supporting member, said upper bar member covering the channels when said upper and lower members are interconnected for retention of said set of cords in the apertures.

14. The hammock of claim 11 wherein the apertures are tubular, longitudinally oriented and parallel to each other.

15. The hammock of claim 11 wherein the apertures of each of said pair of spreader bars are tubular and radially oriented with reference to arc of curvature of each of said pair of spreader bars.

16. The hammock of claim 11 wherein the apertures are evenly spaced apart.

17. The hammock of claim 11 wherein width of each of said pair of spreader bars are approximately equal to shoulder width of an average size user.

18. The hammock of claim 11 wherein said body supporting member includes a set of support cords interconnected to form a net.

19. The hammock of claim 11 wherein said means for attaching includes a pair of rings and a pair of ropes connected to said pair of rings.

20. The hammock of claim 11 wherein said set of suspension cords are knotted at locations inward of said pair of spreader bars and proximal said body supporting member to limit relative movement of said set of suspension cords within and relative to the apertures to prevent encroachment of said pair of bars onto end portions of said body supporting member.

21. A hammock, comprising:

a body supporting member;

a set of suspension cords connected to said body supporting member;

means for attaching said set of suspension cords to a support structure for suspension of said body supporting member therefrom;

a pair of spreader bars, one of said pair of spreader bars positioned at one longitudinal end of said body supporting member and the other of said bars positioned at the longitudinal end of said supporting members, said pair of bars split into upper and lower bar members, said pair of bars having apertures extending through said pair of bars and receiving said of suspension cords therein, said pair of bars having channels extending along an entire length of the apertures, said channels located and oriented so that the apertures are open along their entire length at a side portion of walls defining the apertures thereby providing access thereto when said upper and lower bar members are separated from each other and closed at the one side thereof when said upper and lower bar members are joined together, said channels extending vertically from the apertures and parallel to the apertures throughout their entire vertical height therefrom to a surface of one of said pair of bars.

22. The hammock of claim 21 wherein cross-sectional size of all of the apertures is vertically and laterally larger than cross-sectional size of all individual cords of said set of suspension cords received in their respective ones of the apertures to allow free movement of said all of said set of suspension cords relative to and within the apertures, said all of said set of suspension cords knotted at locations inward of said pair of spreader bars and proximal said body supporting member to limit relative movement of all of said set of suspension cords within and relative to the apertures to prevent encroachment of said pair of bars onto end portions of said body supporting member.

* * * * *